US005279412A

United States Patent [19]

Lee

[11] Patent Number: 5,279,412

[45] Date of Patent: Jan. 18, 1994

[54] SOAP CONTAINER

[76] Inventor: Hwang R. Lee, 539-1 Songjung-Dong, Yusing-ku, Daejon, Choongnam-Do, Rep. of Korea

[21] Appl. No.: 981,514

[22] Filed: Nov. 25, 1992

[30] Foreign Application Priority Data

May 30, 1991 [KR] Rep. of Korea ..... 91-7837[U]

[51] Int. Cl.[5] ..... A47K 5/08

[52] U.S. Cl. ..... 206/77.1; 4/628

[58] Field of Search ..... D6/536-540; 4/628; 206/77.1; 220/212; 248/309.1, 309.2

[56] References Cited

U.S. PATENT DOCUMENTS

| | | | |
|---|---|---|---|
| D. 160,279 | 9/1950 | Sindler | D6/540 |
| D. 286,355 | 10/1986 | Bussell | D6/536 |
| 1,488,456 | 3/1924 | Harper | 206/77.1 |
| 2,851,713 | 9/1958 | Tupper | 220/212 |
| 3,019,549 | 2/1962 | Evans | 206/77.1 |
| 4,446,178 | 5/1984 | Daugherty | 206/77.1 |
| 4,909,384 | 3/1990 | About | 206/77.1 |

FOREIGN PATENT DOCUMENTS

| | | | |
|---|---|---|---|
| 0293064 | 7/1965 | Netherlands | 206/77.1 |

*Primary Examiner*—Jimmy G. Foster

*Attorney, Agent, or Firm*—Birch, Stewart, Kolasch & Birch

[57] ABSTRACT

A soap container including a support plate having a plurality of drain apertures and a plurality of flexible, soft ribs, and a plurality air apertures disposed in the wall of a base thereof, whereby the wet soap disposed within the soap container can be effectively dried and maintained without any damage.

8 Claims, 1 Drawing Sheet

SOAP CONTAINER

BACKGROUND OF THE INVENTION

1. Field of the Invention

The present invention related to a soap container and more particularly, to a soap container including soft, flexible supporting ribs which can have a cone shaped configuration and are made of a synthetic resinous material for effectively drying and retaining the wet soap disposed therewithin.

2. Description of the Related Art

Various types of soap containers having a plurality of drain apertures disposed in the bottom thereof are well known in the art. However, the conventional soap containers suffer from a number of problems such as, for example, (1) it is difficult to drain the collected water from the wet soap since a water film can block the plurality of drain apertures; (2) it is difficult to dry the wet soap since the soap may be surrounded by collected water; and (3) even though the wet soap is eventually dried, the bottom of the dried soap has a rough surface so that it can adversely affect the skin of the user. Thus, the various supporting elements which are utilized to support the soap have a thick and solid construction so that the thick end portions penetrate the soft soap leaving large and irregular undulations which produce a rough surface on the soap which can adversely affect the skin of the user.

SUMMARY OF THE INVENTION

Accordingly, it is an object of the present invention to provide an improved soap container for easily drying and retaining the wet soap disposed therein, which eliminates the above problems encountered with conventional soap containers.

Another object of the present invention is to provide a soap container including a plurality of air apertures disposed in the walls thereof, a support plate provided with a plurality of drain apertures and a plurality of soft, flexible supporting ribs for supporting the soap, whereby the wet soap disposed within the soap container can be effectively dried.

A further object of the present invention is to provide a plurality of supporting ribs which have various configurations such as, for example, a cone shaped (nipple) configuration made of a synthetic resinous material e.g. polyethylene, polypropylene, PVC, polyurethane, etc. for smoothly contacting and supporting the wet soap.

Still another object of the present invention is to provide an improved soap container which is simple in structure, compact for portability, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Briefly described, the present invention relates to an improved soap container including a support plate having a plurality of drain apertures, a plurality of flexible, soft ribs, and a plurality of air apertures disposed on wall of a base thereof, whereby the wet soap disposed within the soap container can be effectively dried and securely maintained without disfiguring the soap.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
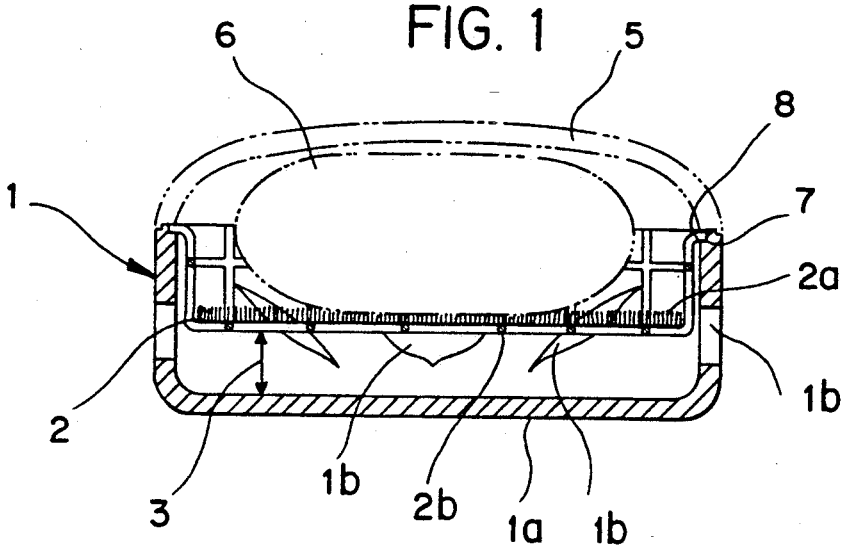
FIG. 1 is a sectional view of the soap container according to the present invention.
Figure 2:
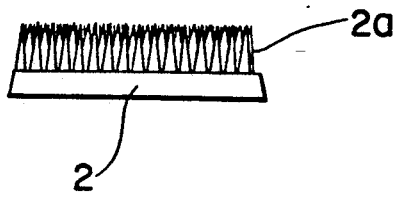
FIG. 2 is a front elevational view of a soft, flexible support ribs disposed on a supporting plate of the soap container of the present invention.

Referring now in detail to the drawings for the purpose of illustrating preferred embodiments of the present invention, the improved soap container as shown in FIGS. 1 and 2, comprises a base (1*a*), a top (5) , a supporting plate (2) having a plurality of flexible, soft ribs (2*a*) dispoed thereon and a plurality of drain apertures (2*b*).

As shown in FIG. 1, the base (1*a*) includes a plurality of air apertures (1*b*) for communicating with the environment for drying the wet soap (6) disposed within the soap container (1). Also, the base (1*a*) further includes a plurality of grooves (7) for receiving a plurality of hook end portions (8) of the supporting plate (2) so as to create a space (3) between the base (1*a*) and the support plate (2). The base (1*a*) also supports by the top (5) by means of hinges, etc. (not shown). The base (1*a*) can also be provided with a plurality of bottom apertures for directly draining the collected water disposed in the soap container (1) (not shown).

As shown in FIG. 2, the flexible, soft ribs (2*a*) of the supporting plate (2) can have various configurations such as, for example, a cone shaped configuration and made of a synthetic resinous material e.g. polyethylene, polypropylene, PVC, polyurethane, etc. The supporting end of the soft ribs have a diameter dimension of 0.01 to about 0.05 mm and when the soft ribs have a cone shape, they can gradually increase in diameter at their base, where they are attached to support plate to about 0.5 to 1 mm. They can also have a height of about 3–7 mm. The flexibility of the ribs can be increased by reducing the diameter of the ribs of the base. The plurality of small diameter, flexible, soft ribs (2*a*) used in the present invention do not damage the surface of the soap (6), because of a minimized contacting area with the soap (6) which also maximizes air drying of the soap (6). Also, any types or shape of soap can be supported and held by the ribs (2*a*).

The soap container (1) of the present invention operates as follows:

After the user uses the soap (6), the user puts the wet soap (6) on the plurality of flexible, soft ribs (2*a*) of the supporting plate (2). At this time, the ribs (2*a*) provide minimial contact with the wet soap (6) and the air drying of the soap (6) is achieved through the plurality of air apertures (1*b*).

On the other hand, the water from the wet soap (6) is transferred to the plurality of drain apertures (2*b*) through the plurality of ribs (2*a*) so as to collect in the bottom of the base (1*a*). At this time, if there are plurality of bottom apertures (not shown), the collected water can be drained therefrom or the user can throw the collected water away. Also, by the plurality of air apertures (1*b*), the moisture of the soap (6) and collected water can be removed.

Accordingly, the soap container (1) of the present invention can support and effectively dry the soap (6) and remove the collected water through the plurality of the air apertures (1*b*).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A soap container comprising:

a base member containing a base wall and side walls therefor, a plurality of air apertures disposed in the side walls of said base member, and a supporting plate suspended within said base member and spaced apart from the bottom wall to define an open area between said supporting plate and said base wall, said open area communicating with said plurality of apertures disposed in said side wall, a plurality of apertures disposed in said supporting plate, and a plurality of flexible, soft ribs supported by and extending from the upper portion of the supporting plate, said flexible, soft ribs being adapted to support a bar of soap.

2. The soap container according to claim 1, wherein said plurality of flexible, soft ribs are made of synthetic resinous material selected from the group consisting of polyethylene, polypropylene, PVC, and polyurethane.

3. The soap container according to claim 1, wherein said supporting plate is hinged to the upper portion of the base member.

4. The soap container according to claim 3, wherein said supporting plate includes a plurality of hook end portions which are inserted into a plurality of grooves disposed in the upper portion of said base member.

5. The soap container according to claim 1, wherein a plurality of apertures are provided in the base wall of the base member.

6. The soap container according to claim 1, wherein the ribs have a cone-shaped configuration.

7. The soap container according to claim 1, wherein the supporting end of the ribs have a diameter of 0.01 to 0.05 mm which increase to a diameter of about 0.5 to 1 mm when they attach to the support plate and have a height of about 3 to 7 mm.

8. The soap container according to claim 1, wherein a top is provided for the base member.

* * * * *